US007730672B2

(12) United States Patent
Knudson et al.

(10) Patent No.: US 7,730,672 B2
(45) Date of Patent: Jun. 8, 2010

(54) INTEGRATED DEBRIS-SHIELDING COVER, FLASHING & MOUNTING SYSTEM FOR RAIN GUTTER

(76) Inventors: Gary A. Knudson, 27795 County Rd. 14, Oak Creek, CO (US) 80467-9615; Patrick D. Flood, 15857 W. 75th Pl., Arvada, CO (US) 80007

( * ) Notice: Subject to any disclaimer, the term of this patent is extended or adjusted under 35 U.S.C. 154(b) by 221 days.

(21) Appl. No.: 11/944,759

(22) Filed: Nov. 26, 2007

(65) Prior Publication Data

US 2008/0120920 A1 May 29, 2008

Related U.S. Application Data

(60) Provisional application No. 60/867,649, filed on Nov. 29, 2006.

(51) Int. Cl.
*E04D 13/00* (2006.01)

(52) U.S. Cl. ..... 52/12; 248/48.1; 248/48.2

(58) Field of Classification Search ..... 52/11, 52/12, 14; 248/48.1, 48.2
See application file for complete search history.

(56) References Cited

U.S. PATENT DOCUMENTS

| | | | | |
|---|---|---|---|---|
| 836,012 | A | | 11/1906 | Cassen |
| 3,752,428 | A | | 8/1973 | Trostle |
| 4,000,587 | A | | 1/1977 | Weber |
| 4,241,548 | A | | 12/1980 | Rowe |
| 4,497,146 | A | | 2/1985 | Demartini |
| 4,757,649 | A | | 7/1988 | Vahldieck |
| 4,796,390 | A | | 1/1989 | Demartini |
| 4,876,827 | A | | 10/1989 | Williams |
| 4,937,986 | A | | 7/1990 | Way |
| 5,040,750 | A | | 8/1991 | Brant |
| 5,189,849 | A | | 3/1993 | Collins |
| 5,251,410 | A | | 10/1993 | Carey |
| 5,305,562 | A | | 4/1994 | Sapia |
| 5,388,377 | A | | 2/1995 | Faulkner |
| 5,406,755 | A | | 4/1995 | Serano |
| 5,457,916 | A | | 10/1995 | Tenute |
| 5,459,965 | A | | 10/1995 | Meckstroth |
| 5,495,694 | A | | 3/1996 | Kuhns |
| 5,575,118 | A | * | 11/1996 | Vahldieck ..... 52/11 |
| 5,592,783 | A | | 1/1997 | Jones |
| 5,595,027 | A | | 1/1997 | Vail |
| 5,617,678 | A | | 4/1997 | Morandin |
| 5,640,809 | A | | 6/1997 | Iannelli |
| 5,640,810 | A | | 6/1997 | Pietersen |
| 5,737,879 | A | | 4/1998 | Sweet |
| 5,845,435 | A | | 12/1998 | Knudson |
| 5,893,240 | A | * | 4/1999 | Ealer, Sr. ..... 52/12 |
| 6,016,631 | A | | 1/2000 | Lowrie |
| 6,073,398 | A | | 6/2000 | Williams |

(Continued)

*Primary Examiner*—Richard E Chilcot, Jr.
*Assistant Examiner*—Theodore Adamos
(74) *Attorney, Agent, or Firm*—Ancel W. Lewis, Jr.

(57) ABSTRACT

A rain gutter system includes a back flashing, fastening clips, fasteners, a rain gutter and a reverse-curve shield. The back flashing overlaps existing flashing and has a crease at the bottom and the fastening clips have a groove that locates the fastening clips relative to the back flashing. The back wall of the rain gutter extends above and behind the bottom of the back flashing. The rain gutter and shield are anchored to the back flashing and fastening clips vertically and in the fore/aft direction, and can slide laterally. The front upper end of the rain gutter slopes up and back to improve debris shedding.

13 Claims, 4 Drawing Sheets

U.S. PATENT DOCUMENTS

| | | | | |
|---|---|---|---|---|
| 6,098,344 | A | 8/2000 | Albracht | |
| 6,098,345 | A | 8/2000 | Demartini | |
| 6,269,592 | B1 | 8/2001 | Rutter | |
| 6,412,228 | B1 | 7/2002 | Meckstroth | |
| 6,463,700 | B2 | 10/2002 | Davis | |
| 6,493,993 | B1 | 12/2002 | Serano | |
| 6,536,165 | B2 | 3/2003 | Pilcher | |
| 6,594,956 | B1 | 7/2003 | Willing | |
| 6,658,796 | B1 | 12/2003 | Higgins | |
| 6,672,012 | B2 | 1/2004 | Bahroos et al. | |
| 6,681,527 | B2 | 1/2004 | Baker | |
| 6,688,045 | B1 | 2/2004 | Pilcher | |
| 6,701,674 | B1 | 3/2004 | Albracht | |
| 6,732,477 | B1 | 5/2004 | Richard | |
| 6,735,907 | B2 | 5/2004 | Stevens | |
| 6,745,517 | B2 | 6/2004 | Vahldieck | |
| 6,823,630 | B2 | 11/2004 | Marra | |
| 6,826,872 | B2 | 12/2004 | Brochu | |
| 6,904,718 | B2 | 6/2005 | Fox | |
| 6,944,991 | B2 | 9/2005 | Kim | |
| 6,944,992 | B2 | 9/2005 | Brochu | |
| 6,968,651 | B2 | 11/2005 | Bergeron | |
| 6,993,870 | B2 | 2/2006 | McDonald et al. | |
| 6,993,871 | B2 | 2/2006 | Richard et al. | |
| 7,082,723 | B2 | 8/2006 | Gramling | |
| 7,104,011 | B1 | 9/2006 | Knight | |
| 7,104,012 | B1 | 9/2006 | Bayram | |
| 7,117,643 | B2 | 10/2006 | Brown | |
| 7,257,933 | B2 | 8/2007 | Walters | |
| 2004/0000098 | A1* | 1/2004 | Knudson | 52/12 |
| 2004/0025445 | A1* | 2/2004 | Walters | 52/11 |
| 2004/0040219 | A1 | 3/2004 | Bacik et al. | |
| 2004/0244304 | A1 | 12/2004 | Bullinger | |
| 2005/0000167 | A1 | 1/2005 | Richard et al. | |
| 2005/0115158 | A1 | 6/2005 | Brown | |
| 2005/0172565 | A1 | 8/2005 | Riley et al. | |
| 2007/0119104 | A1 | 5/2007 | Pijanowski | |
| 2007/0130842 | A1 | 6/2007 | Walters | |
| 2008/0000169 | A1* | 1/2008 | Handley | 52/12 |

* cited by examiner

INTEGRATED DEBRIS-SHIELDING COVER, FLASHING & MOUNTING SYSTEM FOR RAIN GUTTER

This application claims the benefit under 35 U.S.C. § 119(e) of the U.S. provisional patent application No. 60/867,649 filed Nov. 29, 2006.

TECHNICAL FIELD

The present invention relates to rain gutters for buildings and more particularly to an integrated rain gutter, reverse-curve shield, back flashing and fastening clip system.

BACKGROUND ART

Open trough rain gutters collect debris that falls on the roof and washes down with the rain water. Systems to shield the rain gutter from debris include screens over the open trough and reverse-curve shields. The screens have a tendency to clog with small debris, blocking the rain water from entering the rain gutter.

Reverse-curve shields or hoods generally have a sloped planar section that extends over the rain gutter and a coextensive curved section that first curves forwardly and downwardly over the front of the rain gutter and then curves downwardly and inwardly. Rain water, through liquid adhesion principles, follows the curved section to the lower edge of the shield and falls from this lower edge into the rain gutter. Debris washed down by the rain water falls off at the forward extent of the curved section of the shield and drops to the ground.

Known reverse-curve shields can generally be divided into two types. In a first type, the rear of the shield is integrated into the roof, typically by sliding the rear edge of the shield under the lower, forward edge of the roof covering. Reverse-curve shields typically require a certain amount of vertical spacing above the rain gutter. Open top rain gutters are generally mounted as high as possible on the eave, adjacent to the lower edge of the roof. When a reverse-curve shield is added over an open top rain gutter, the required vertical spacing of the shield above the rain gutter can result in the rear edge of the shield being higher than the roof edge. In order to achieve an appropriate geometric configuration of the shield relative to the rain gutter for correct functionality, this first type of reverse-curve shield is typically used when a reverse-curve shield is added over an existing open top rain gutter.

In the second type of reverse-curve shield, the shield mounts only over the rain gutter, independent of the roof. This second type of reverse-curve shield is mounted with specialized fastening clips and typically mounted with the rain gutter as part of an integrated system. When positioned correctly, the shield is located slightly below the roof edge and completely above both the front edge and back edge of the rain gutter. This type of positioning often leaves the back edge of the gutter located well below the existing flashing with the fascia behind the gutter exposed and susceptible to leakage behind the gutter.

Seams or joints in a rain gutter can leak. Seamless rain gutters, with a single seamless section of rain gutter along each straight section of guttered eave, reduce the possibility of leakage and are preferable over rain gutters with joints or seams along straight sections of rain gutter. In many known rain gutters, including many seamless rain gutters, the fasteners that attach the rain gutter to the eave, pierce the rain gutter. Differential thermal expansion between the rain gutter and eave can generate stress on these fasteners, creating a possibility of failure. A mounting system for a rain gutter that allows the rain gutter and shield to independently expand relative to the eave is desirable.

DISCLOSURE OF THE INVENTION

An integrated covered rain gutter system includes a back-flashing, a plurality of fastening clips, a fastener for each fastening clip, an open-top rain gutter, and a reverse-curve shield. The fasteners extend through the base of the fastening clips and the back flashing to anchor the fastening clips and the back flashing to the fascia. The rain gutter and the shield are each mounted on the back flashing and/or the fastening clips, each being anchored vertically and in a fore/aft direction while being allowed to float laterally to prevent stress from thermal expansion. The upper back end of the rain gutter extends behind the lower edge of the back flashing. The upper front end of the rain gutter has an angled face to improve debris shedding. One end of the shield has a barb that is received into a shaped receiving slot on the fastening clips to semi-permanently attach the shield. Means are provided for uniformly locating or aligning the fastening clips relative to the shield.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
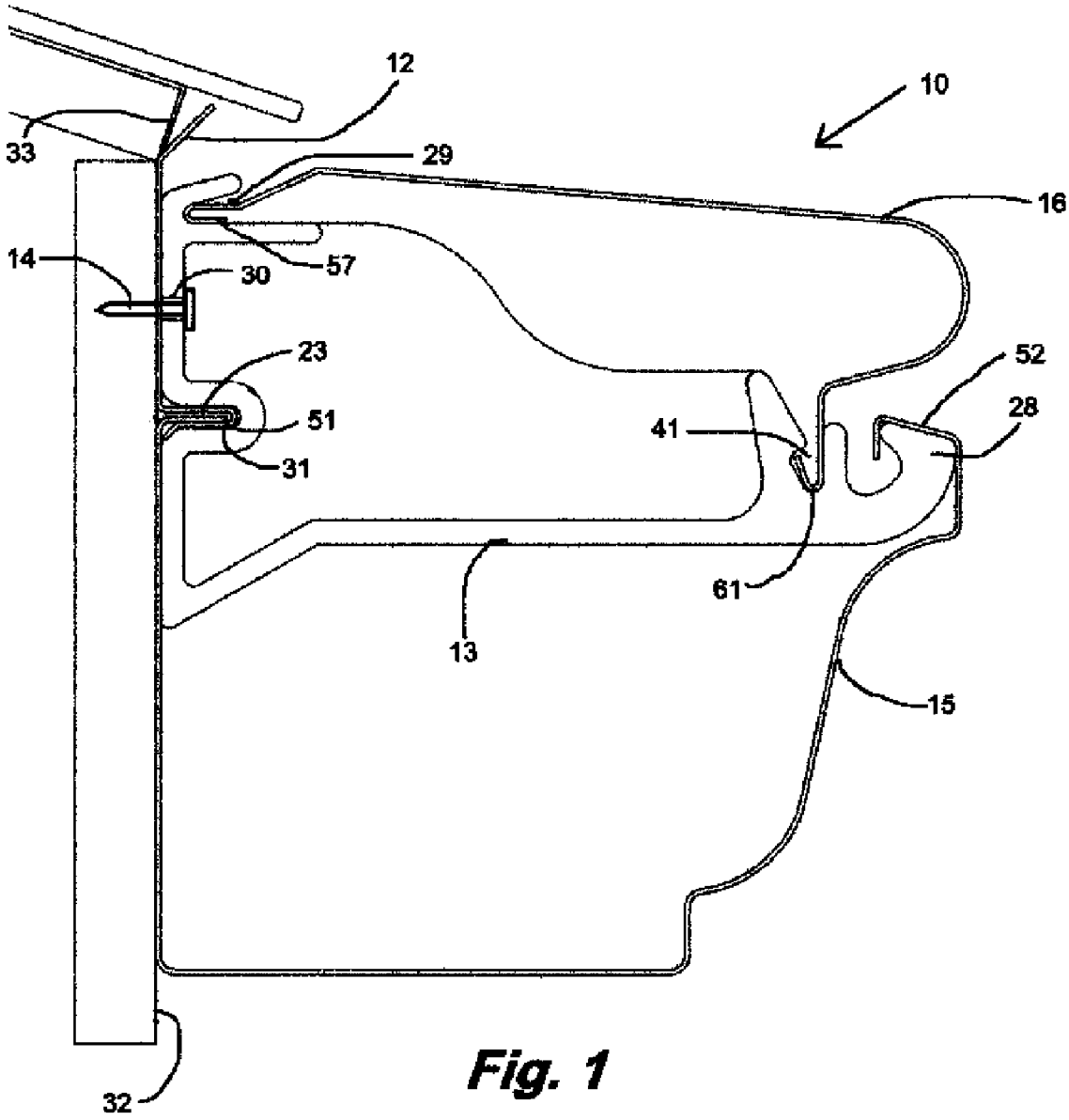
FIG. 1 is a side plan view of a covered rain gutter system embodying features of the present invention.
Figure 2:
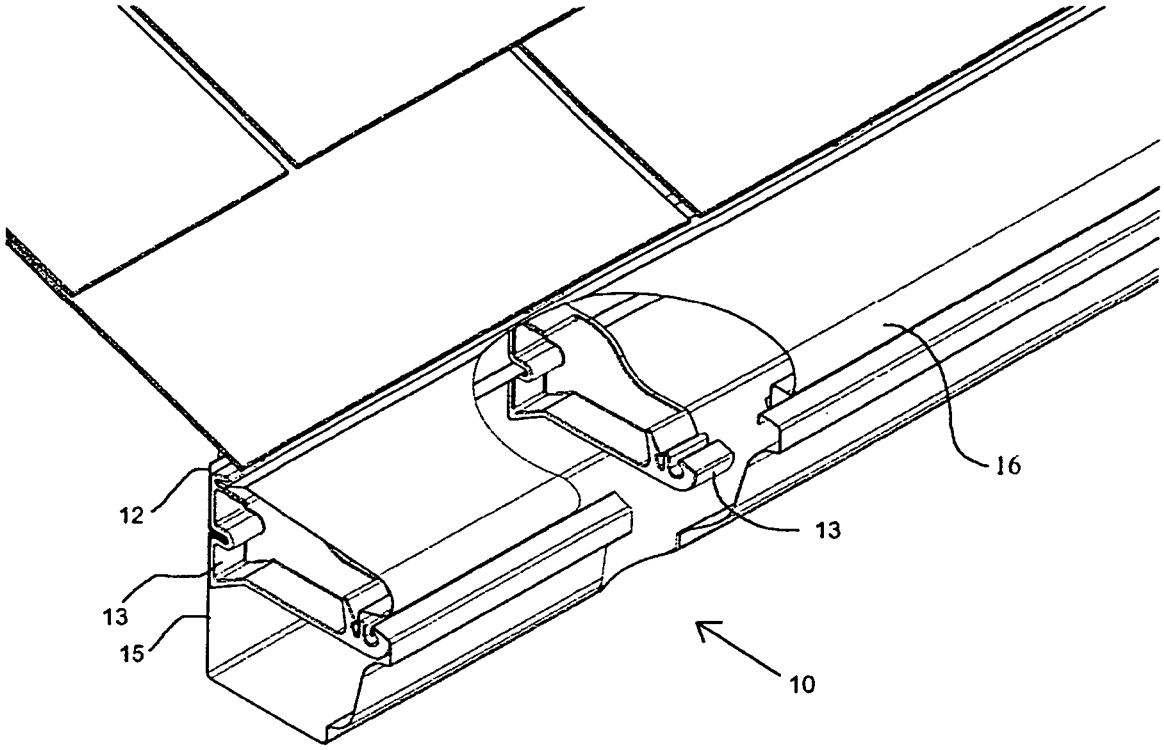
FIG. 2 is a perspective, partially cut-away view of the system of FIG. 1.

Referring now to FIGS. 1 and 2, an integrated covered rain gutter system 10 embodying feature of the present invention includes a back-flashing 12, a plurality of fastening clips 13, fastener 14 for each fastening clip 13, an open-top rain gutter 15, and a reverse-curve shield 16. The back flashing 12, rain gutter 15 and reverse-curve shield 16 are preferably each roll formed from sheet metal. The back flashing 12, rain gutter 15 and reverse-curve shield 16 could also be plastic and could be molded or extruded. The advantage to roll forming is that the length of each back flashing 12, rain gutter 15 and reverse-curve shield 16 can be tailored to the length of each eave, so that a substantially seamless rain gutter system 10 can be provided.

Describing the specific embodiments herein chosen for illustrating the invention, certain terminology is used which will be recognized as being employed for convenience and having no limiting significance. For example, the terms "front" and "forward" will refer to directions away from the fascia or eave and "back" or "rearward" will refer to directions toward from the fascia or eave on which the rain gutter is installed. With reference to the drawings, this means that "forwardly" is to the right and "rearwardly" is to the left. Further, all of the terminology above-defined includes derivatives of the word specifically mentioned and words of similar import.

Figure 3:
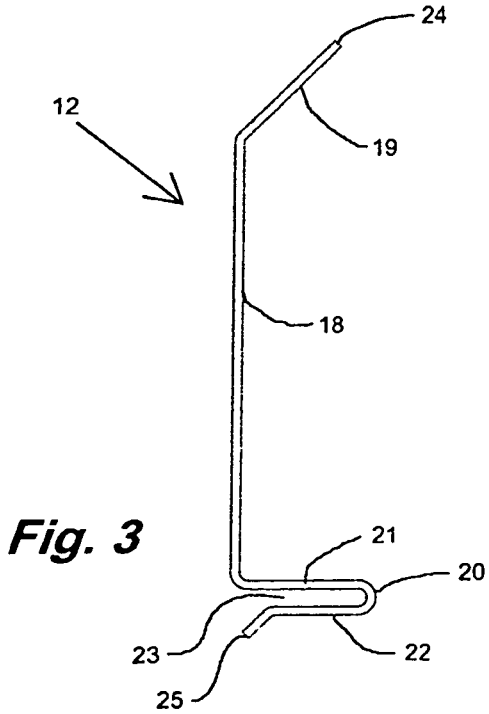
FIG. 3 is a side plan view of the back flashing of FIG. 1.

The back flashing 12, as shown in FIG. 3, has a substantially vertical, planar intermediate portion 18, a generally planar upper portion 19 that extends upwardly and forwardly from the top of the intermediate portion 18 to an upper edge 24, and a crease 20 that projects forwardly from the bottom of the intermediate portion 18. The crease 20 is formed with a forwardly projecting first fold 21 from the bottom of the intermediate portion 18 connected to a spaced, generally parallel, second fold 22 that projects rearwardly below the first fold 21 to a lower edge 25, with a rearwardly opening slot 23 being formed between the first and second folds 21 and 22.

Figure 4:
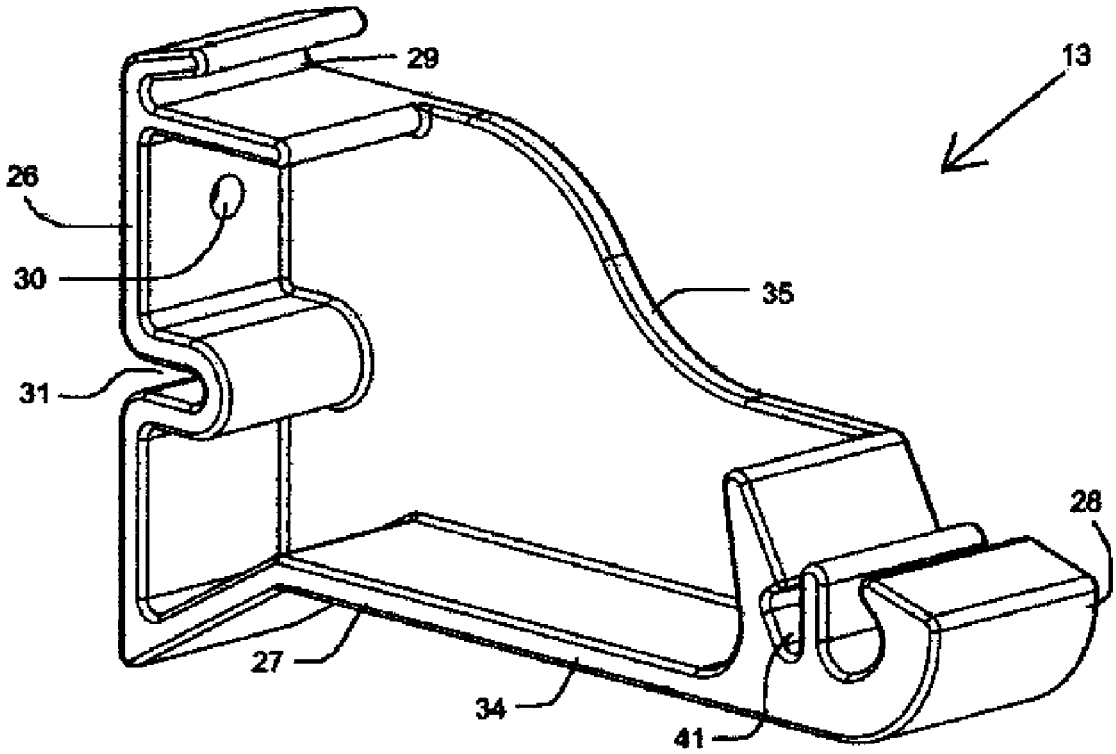
FIG. 4 is a perspective view of the fastening clip of FIG. 1.
Figure 5:
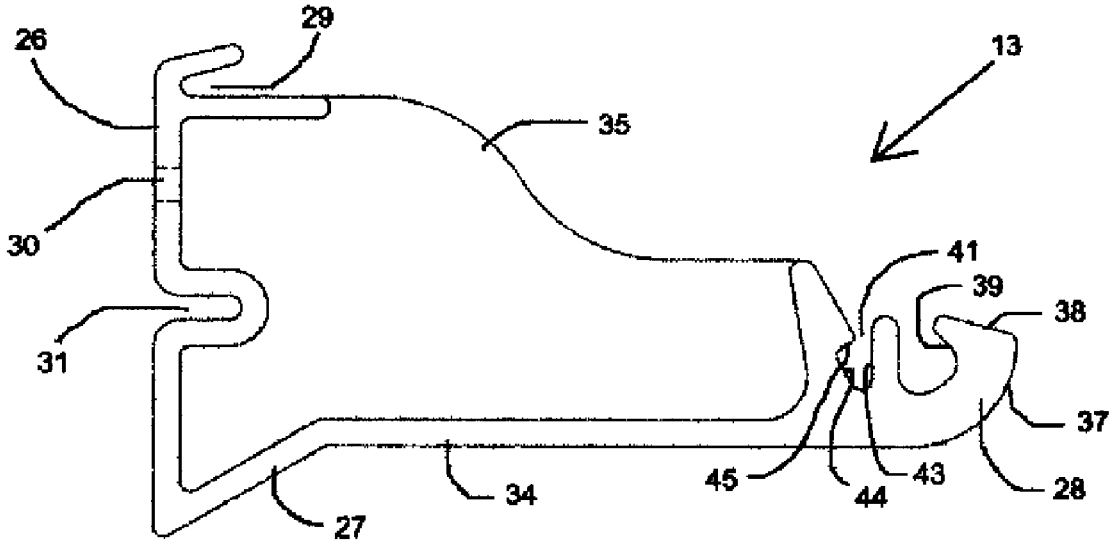
FIG. 5 is a side plan view of the fastening clip of FIG. 1.

Referring to FIGS. 4 and 5, the fastening clip 13 has a base 26 and a support body 27 that extends forwardly from the base 26 to a forward end 28. The fastening clip 13 can be molded plastic. The base 26 is generally vertical, and has a forwardly opening first receiving slot 29 at the top of the base 26, a fastener aperture 30 below the first receiving slot 29, and a rearwardly opening groove 31 below the fastener aperture 30.

As shown in FIG. 1, the groove 31 is sized and shaped to receive the crease 20 of the back flashing 12, and in cooperation with the crease 20 of the back flashing 12, provides a means for aligning the fastening clips 13 with the back flashing 12. The back flashing 12 is mounted to the fascia 32, with the fastening clips 13 spaced along the back flashing 12, by a fastener 14 that extends through the fastener aperture 30 in each fastening clip 13, through the back flashing 12 and into the fascia 32. The back flashing 12 preferably overlaps the existing flashing 33. The upper portion 19 of the back flashing 12 extends above the top of the base 26 of each fastening clip 13 to protect the fascia 32 above the top of the base 26.

Referring again to FIGS. 4 and 5, the support body 27 of the fastening clips 13 has a lower portion 34 and a web portion 35. The lower portion 34 extends upwardly and forwardly from the bottom of the base 26 and then horizontally forwardly to the forward end 28. The forward end 28 has a lower surface 37 that curves upwardly and forwardly, and an upper surface 38 that slopes upwardly and rearwardly from the front of the lower surface 37. A rearward surface 39 of the forward end 28 curves, from the back of the upper surface, downwardly, then downwardly and forwardly and then downwardly and rearwardly.

The lower portion 34 of the support body 27 has an upwardly opening second receiving slot 41 spaced rearwardly from the rearward surface 39 of the forward end. The second receiving slot 41 has a generally barb shape with a substantially vertical forward surface 43, a lower rearward surface 44 that slants upwardly and rearwardly and an upper rearward surface 45 that slants upwardly and forwardly so that the second receiving slot 41 tapers at the top. The web portion 35 is a vertical wall that extends upwardly from the lower portion 34 to the first receiving slot 29 and forwardly from the base 26 to the second receiving slot 41.

Figure 6:
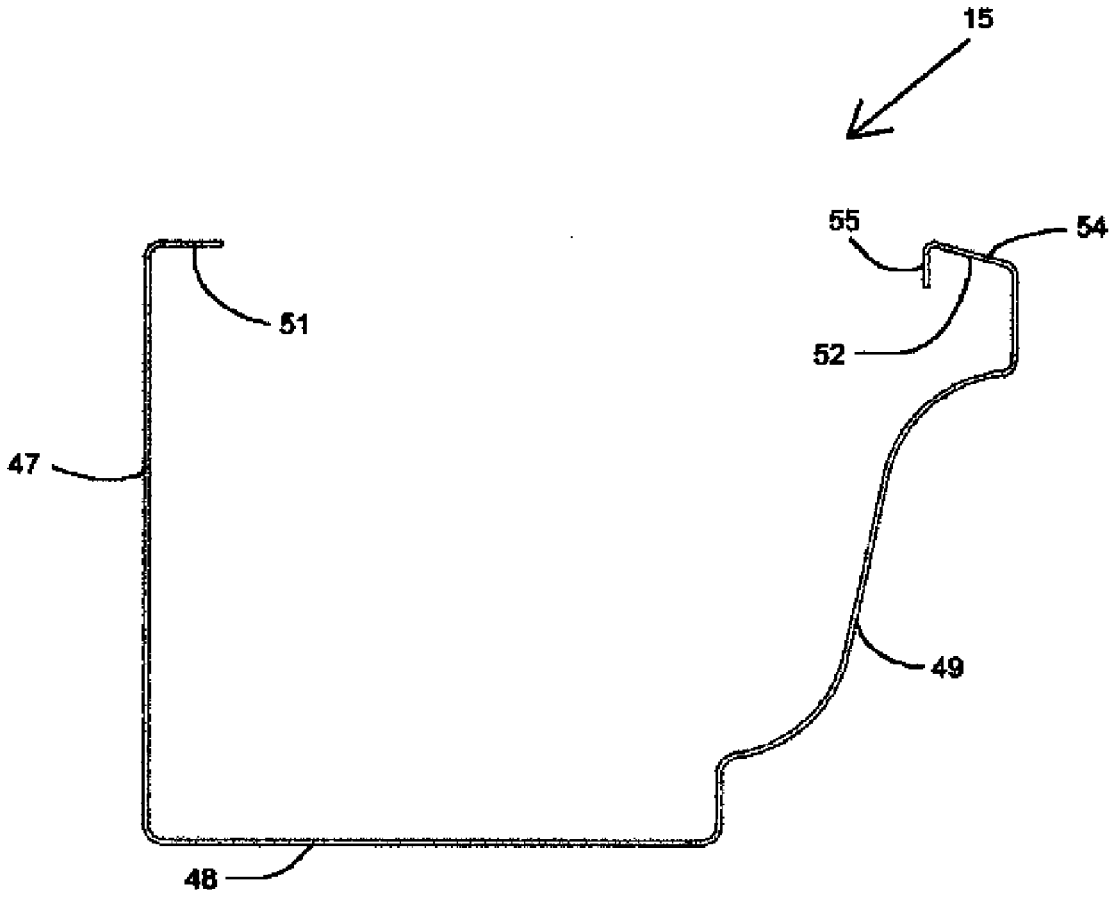
FIG. 6 is a side plan view of the rain gutter of FIG. 1.

As shown in FIG. 6, the rain gutter 15 has an open top trough shape and includes a back wall 47, a bottom wall 48 and a front wall 49. The back wall 47 is generally planar and vertical. The bottom wall 48 projects forwardly from the bottom of the back wall 47, and is generally planar and horizontal. The front wall 49 projects upwardly and forwardly from the bottom wall 48, and is shaped. The front wall 49 shape is first vertical, then transitions into a forwardly convex curve, then transitions into a forwardly concave curve, and then transitions to vertical again.

The upper back end 51 of the rain gutter 15 is formed by a forwardly projecting right angle bend at the top of the back wall 47. The upper front end 52 of the rain gutter 15 has a front portion 54 that angles rearwardly and upwardly from the top of the front wall 49, and a rear portion 55 projects downwardly from the back of the front portion 54. As shown in FIG. 1 the upper back end 51 fits into the slot 23 in the back flashing 12 and the upper front end 52 fits over the forward end 28 of the fastening clip 13, so that the rain gutter 15 is slidably mounted to and floats relative to the back flashing 12 and the fastening clip 13. The upper back end 51 fitting into the slot 23 places the upper back end 51 above and behind the bottom of the back flashing 12, preventing leakage between the bottom of the back flashing 12 and the top of the back wall 47 of the rain gutter 15. The angled front portion 54 of the upper front end 52 enhances debris shedding.

Figure 7:
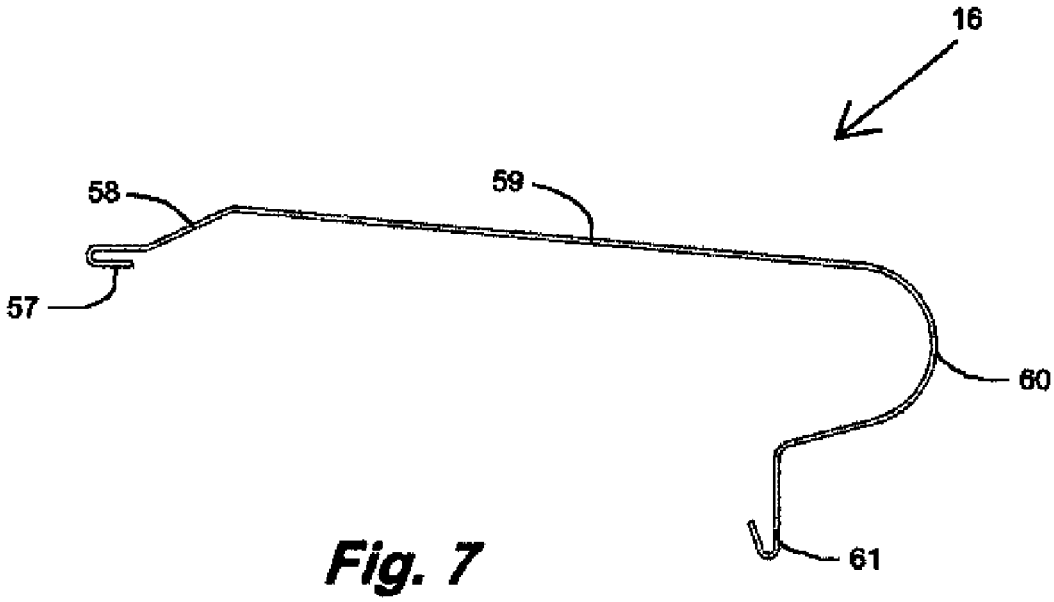
FIG. 7 is a side plan view of the shield of FIG. 1.

Referring to FIG. 7, the reverse-curve shield 16 includes a substantially horizontal first end 57, a substantially planar rearward section 58 that slopes forwardly and upwardly from the first end 57, a substantially planar intermediate section 59 that slopes forwardly and downwardly from the rearward section 58 and a reverse curve forward section 60 that extends forwardly from the rearward section 59 to a second end 61. The forward section 60 curves downwardly until the forward section 60 projects rearwardly. The first end 57 shown is a downward and forward 180 fold. The second end 61 has a barb shape, extending downwardly from the forward section 60 and then folding rearwardly to project upwardly and rearwardly at an angle.

As shown in FIG. 1, the first end 57 of the reverse-curve shield 16 fits into the first receiving slot 29 of the fastening clip 13. The second end 61 of the reverse-curve shield 16 fits into the second receiving slot 41 of the fastening clip 13. The first and second receiving slots 29 and 41 position the intermediate section 59 of the reverse-curve shield 16 at a selected angle and the front of forward section 60 the of the reverse-curve shield 16 at a selected alignment over the front of the rain gutter 16. The complementary barb shapes of the second end 61 of the reverse-curve shield 16 and the second receiving slot 41 of the fastening clip 13 allow the second end 61 of the reverse-curve shield 16 to snap into the second receiving slot 41 of the fastening clip 13, providing semi-permanent mounting of the reverse-curve shield 16 and preventing the wind from dislodging the reverse-curve shield 16. The reverse-curve shield 16 is slidably mounted to and floats relative to the fastening clips 13. The first and second receiving slots 29 and 41 are positioned, and the reverse-curve shield in shaped to place the intermediate section 59 at a selected angle with the forward section 60 at a selected alignment over the upper front end 52 of the rain gutter 15.

Although the present invention has been described with a certain degree of particularity, it is understood that the present disclosure has been made by way of example and that changes in details of structure may be made without departing from the spirit thereof.

What is claimed is:

1. A covered rain gutter system mounting on a fascia below a roof of a building comprising:

a back flashing having an upper edge and a lower edge, a plurality of spaced fastening clips along said back flashing, a fastener for each fastening clip, said fasteners extending through said fastening clips and said back flashing to anchor said fastening clips and said back flashing to said fascia, and an upwardly opening, trough shaped rain gutter having a back wall and a spaced front wall opposite said back wall, said back wall extending upwardly between said lower edge of said back flashing and said fascia to an upper back end that terminates below said fasteners, said back wall laterally slidably mounting to one of said back flashing and said fastening clips, and said front wall laterally slidably mounting to said fastening clips, and a reverse-curve shield having a first end, and a spaced second end opposite said first end, said first end laterally slidably mounting to said fastening clips and said second end laterally slidably mounting to said fastening clips, whereby said rain gutter and said shield float laterally relative to said fascia while being anchored vertically and in a fore and aft direction.

2. The system as set forth in claim 1 wherein said fastening clips each include a forwardly opening first receiving slot and a spaced upwardly opening second receiving slot, said first receiving slot being sized and shaped to receive said first end of said reverse-curve shield, said second receiving slot being sized and shaped to receive said second end of said reverse-curve shield, said first and second receiving slots being located to place said reverse-curve shield at a selected angle and at a selected alignment over said rain gutter, whereby said first and second receiving slots laterally slidably mount said reverse-curve shield on said fastening clips.

3. The system as set forth in claim 2 wherein said second receiving slot has a barb shape and said second end of said reverse-curve shield has a barb shape sized and shaped to fit into said second receiving slot, whereby said second end of said reverse-curve shield snaps into said second receiving slot to semi-permanently mount said reverse-curve shield to said mounting clips.

4. The system as set forth in claim 1 including means for aligning said fastening clips along said back flashing.

5. The system as set forth in claim 4 wherein:

said fastening clips each have a base and a support body extending forwardly from said base, said support body having a forward end, and said means for aligning includes a forwardly projecting crease in said back flashing and a rearwardly opening groove in said base of said fastening clips that is sized and shaped to receive said crease.

6. The system as set forth in claim 5 wherein said upper back end of said back wall of said rain gutter includes a forwardly projecting fold and said crease in said back flashing forms a rearwardly opening slot sized to receive said fold, whereby said upper back end of said back wall of said rain gutter is sandwiched between said back flashing and said fascia to anchor said upper back end in the fore and aft direction and said slot anchors said upper back end vertically, while said upper back end float laterally in said slot.

7. The system as set forth in claim 1 wherein said front wall of said rain gutter includes an upper front end, and said upper front end includes an upwardly and rearwardly angled front portion for improving debris shedding.

8. The system as set forth in claim 1 wherein said back flashing extends above said fastening clips to protect said fascia.

9. The system as set forth in claim 1 wherein said rain gutter is made of roll formed sheet metal.

10. The system as set forth in claim 1 wherein said back flashing is made of roll formed sheet metal.

11. The system as set forth in claim 1 wherein said reverse-curve shield is made of roll formed sheet metal.

12. A covered rain gutter system mounting on a fascia below a roof of a building comprising:

a back flashing having an upper edge, a lower edge, a forwardly projecting crease at said lower edge, said crease forming a rearwardly opening slot, a plurality of spaced fastening clips along said back flashing, each having a base and a support body extending forwardly from said base, said support body having a forward end, said base having a forwardly opening first receiving slot, said support body having a spaced upwardly opening second receiving slot behind said forward end, said second receiving slot having a barb shape, and said base having a rearwardly opening groove that is sized and shaped to receive said crease of said back flashing, a fastener for each fastening clip, said fasteners extending through said fastening clips and said back flashing to anchor said fastening clips and said back flashing to said fascia, an upwardly opening, trough shaped rain gutter having a back wall with an upper back end and a spaced front wall with an upper front end opposite said upper back end, said upper back end extending between said lower edge of said back flashing and said fascia, said upper back end terminating below said fasteners, said upper back end laterally slidably mounting to one of said back flashing and said fastening clips, said upper front end laterally slidably mounting to said fastening clips, and said upper front end including an upwardly and rearwardly angled front portion for improving debris shedding, and a reverse-curve shield having a first end, a substantially planar intermediate section that extends forwardly relative to said first end and downwardly and a reverse curve forward section that curves downwardly from said intermediate section to a second end, said first end being sized and shaped to fit into said first receiving slot of said fastening clips and said second end having a barb shape sized and shaped to fit and snap into said second receiving slot of said fastening clips, whereby said rain gutter and said shield float laterally relative to said fascia while being anchored vertically and in a fore and aft direction.

13. A covered rain gutter system mounting on a fascia below a roof of a building comprising:

a back flashing having an upper edge and a lower edge, a plurality of spaced fastening clips along said back flashing, each having a base and a support body extending forwardly from said base, said support body having a forward end, a fastener for each fastening clip, said fasteners extending through said fastening clips and said back flashing to anchor said fastening clips and said back flashing to said fascia, an upwardly opening, trough shaped rain gutter having a back wall with an upper back end and a spaced front wall with an upper front end opposite said upper back end, said upper back end extending between said lower edge of said back flashing and said fascia, said upper back end terminating below said fasteners, said upper back end laterally slidably mounting to one of said back flashing and said fastening clips, and said upper front end laterally slidably mounting to said fastening clips, and a reverse-curve shield having a first end, a substantially planar intermediate section that extends forwardly relative to said first end and downwardly and a reverse curve forward section that curves downwardly from said intermediate section to a second end, said first end laterally slidably mounting to said fastening clips and said second end laterally slidably mounting to said fastening clips, whereby said rain gutter and said shield float laterally relative to said fascia while being anchored vertically and in a fore and aft direction.

* * * * *